United States Patent [19]

Maeder

[11] 4,262,512

[45] Apr. 21, 1981

[54] DRAWING AND IRONING ASSEMBLY FOR BODYMAKER

[75] Inventor: Edward G. Maeder, Minnetonka, Minn.

[73] Assignee: National Can Corporation, Chicago, Ill.

[21] Appl. No.: 900,272

[22] Filed: Apr. 26, 1978

[51] Int. Cl.[3] ..... B21B 45/02

[52] U.S. Cl. ..... 72/45; 72/349

[58] Field of Search ..... 72/43, 44, 45, 344, 72/348, 349, 427; 113/120 H

[56] References Cited

U.S. PATENT DOCUMENTS

| | | | |
|---|---|---|---|
| 3,399,558 | 9/1968 | Smith et al. | 72/468 |
| 3,656,335 | 4/1972 | Kaminski | 72/349 |
| 3,664,171 | 5/1972 | Paramonoff | 72/349 |
| 3,670,543 | 6/1972 | Bolt | 72/349 |
| 3,735,629 | 5/1973 | Paramonoff | 113/120 H |
| 3,967,482 | 7/1976 | Kubachie et al. | 72/349 |
| 4,109,502 | 8/1978 | Schaeffer | 72/349 |

FOREIGN PATENT DOCUMENTS 724251 2/1955 United Kingdom .

*Primary Examiner*—Leon Gilden

*Attorney, Agent, or Firm*—Robert A. Stenzel; Ralph R. Rath

[57] ABSTRACT

A drawing and ironing assembly consists of a redraw assembly, at least one ironing assembly and a stripper assembly that cooperate with a punch to redraw a cup and then iron the sidewall thereof. The redraw assembly includes a support and a redraw ring which are also biased to a centered position and a floating air bearing is defined between the support and the frame surface to reduce friction while a nesting ring is located adjacent the redraw ring. Lubricating means are provided for creating a generally circumferential flow into the opening in the nesting ring. The stripper assembly includes a support which carries the stripper elements and the support is biased to a centered position with respect to a predetermined axis or path for the punch and fluid is supplied to relatively movable surfaces to assist in reducing friction.

10 Claims, 4 Drawing Figures

14
28
A
10
20
29
12
25
22
22
24
P
26

DRAWING AND IRONING ASSEMBLY FOR BODYMAKER

BACKGROUND OF THE INVENTION

The present invention relates generally to ironing machines or bodymakers and more specifically to an improved drawing and ironing apparatus for use with a punch that reforms the cup and then reduces the sidewall thereof.

In the formation of a "two-piece" container, it has been customary to utilize a plurality of die assemblies that cooperate with a punch for converting circular metal discs into finished containers. Usually this is accomplished in two steps. A circular metal disc is originally drawn into a cup utilizing what is commonly referred to as a cupping machine. The cup is then transferred to a bodymaker or press wherein the cup is converted into the finished container. One type of commercial machine that is presently available is produced by Ragsdale Bros., Inc. and is identified as a Model CR-24 can wall drawing and ironing press.

The press or bodymaker of this type includes a cup redraw assembly, a plurality of ironing assemblies and a stripper assembly arranged seriatim along a path for a punch. The cups for this machine are originally larger in diameter than the finished internal diameter of the container and the cup is initially redrawn by the redraw assembly and the sidewall thereof is then reduced in thickness by cooperation between the punch and the plurality of ironing assemblies. At the end of the stroke for the punch, the end wall of the container is reformed generally to a dome shaped configuration.

In order to produce conventional 12 and 16 ounce containers, the length of the stroke of the punch for the press or bodymaker must be fairly long and has heretofore created substantial problems in producing a satisfactory container which has a uniform wall thickness in the sidewall thereof. One of the problems encountered has been in maintaining all of the elements in very accurate alignment with respect to each other in order to produce a finished container that has a uniform wall thickness around the entire perimeter thereof and also along the entire length thereof.

In order to alleviate some of the problems in maintaining accurate alignment between the various die assemblies and the punch, it has previously been proposed to utilize floating ironing die assemblies so that the ironing die can move radially of the path of the punch in order to obtain a more uniform sidewall thickness for the finished container. For example, British Pat. No. 724,251, published Feb. 16, 1955, discloses a method of supporting ironing dies that will accommodate movement of the dies with respect to the punch but will also provide a self-centering feature which theoretically will reposition the die to a predetermined position whenever external forces have been removed. The particular arrangement for accomplishing the self-centering and floating feature in the assembly disclosed in the British patent consists of cooperating inclined surfaces between the ironing die and its support mechanism with a biasing mechanism which will also center the ironing dies with respect to a predetermined axis whenever external forces are removed. The biasing mechanism in this patent has been illustrated as either consisting of an elastomeric member or rubber ring which produces a centering action between the ironing die and the cooperating support or springs that cooperate with the ironing die and the support to center the die with respect to a predetermined axis.

Other types of centering means have been utilized in conjunction with the ironing assemblies. Another example consists of an ironing die support which supports an ironing ring with a centering ring surrounding the ironing ring. The centering ring has spring biased plungers biased into engagement with the periphery of the support to accommodate radial movement of the support with respect to the predetermined path.

The centering mechanisms consisting of radially biased plungers have been used successfully in overcoming problems in obtaining uniform wall thickness for the container. However, one additional problem has been encountered in the reforming of the cup in a redrawing process. Heretofore, it has been deemed necessary to have the redraw ring which cooperates with the punch in a fixed position which defines the centered position for the punch during its stroke in producing a drawn and ironed container.

In redrawing a cup to its reduced diameter it is customary to utilize a sleeve that cooperates with the redraw ring and is initially inserted into the cup and forces the cup against the top surface of the redraw ring. Thereafter, the punch is passed through the sleeve and forces the cup through the redraw ring. Thus, if there is any misalignment between the sleeve and the redraw ring, the cup will be redrawn unevenly which may result in an unsatisfactory cup since there may not be sufficient metal around certain peripheral portions of the sidewall in order to produce a container of a particular height.

In one type of redraw assembly, a nesting ring surrounds the opening in the redraw ring and has an opening which conforms to the original size of the cup. The nesting ring is fixed with respect to the redraw ring and acts as a pilot for generally centering the cup with respect to the redraw ring.

A further problem that has been encountered is the inability of supplying lubricants in an accurate controlled flow between the surface of the redraw ring and the adjacent surface of the cup in the most critical area which is the area above or on the upper surface of the redraw ring.

A further problem encountered with drawing and ironing assemblies of the above type relates to the stripper assembly. If the ironing rings are mounted in a floating fashion, the ironing rings will assume a centered position with respect to the axis of the punch as the punch passes therethrough. This will result in a fairly uniform wall thickness of the container. However, should the axis of the punch be offset to some degree with respect to a predetermined path, the stripper assembly may cause damage to the outer surface of the container, such as producing scratches therein which will make the container unsatisfactory for use. Also, if the stripper assembly is not exactly aligned with the axis of the punch, the stripper jaws may apply unequal forces to the free edge of the container and deform the edge and rim of the container. In certain cases of mislaignment, some of the stripper jaws may not engage the edge of the container.

SUMMARY OF THE INVENTION

According to the present invention, a drawing and ironing assembly includes a redraw die assembly that is floatingly mounted with respect to the axis of the punch associated therewith so as to be movable in a radial plane with respect to the axis of the punch and the assembly is normally held in a centered position with respect to the path for the punch by biasing springs that cooperate with the periphery of the assembly. The assembly includes a support and a redraw ring carried by the support and also preferably includes an enlarged nesting ring which acts as a pilot for receiving and accurately positioning the cup with respect to the redraw ring.

According to one aspect of the invention, the redraw die assembly also incorporates lubricating means for supplying lubricant to the inner face between the redraw ring and the cup to reduce the frictional forces and produce a cup having a better finish. The lubricating means consists of an annular lubricating channel within the support surrounding the nesting ring with the channel being in communication with the opening in the ring through a plurality of circumferentially spaced flow paths which have their inner ends terminating non-radially with respect to the center of the opening in the ring. This arrangement creates a swirling or vortex flow for the lubricant fluid to the opening in the ring during the redraw operation and also cools the redraw ring during the remainder of the cycle.

The redraw ring assembly also is supported on a fluid bearing within the frame for the assembly to reduce frictional forces and aid in accommodating radial movement of the assembly with respect to the path.

According to a further aspect of the invention, the stripper assembly of the drawing and ironing assembly is also mounted for radial movement with respect to the path and is again centered with respect to the path by centering springs that cooperate with the periphery of the assembly and is supported on a fluid bearing in the frame.

DETAILED DESCRIPTION

Figure 1:
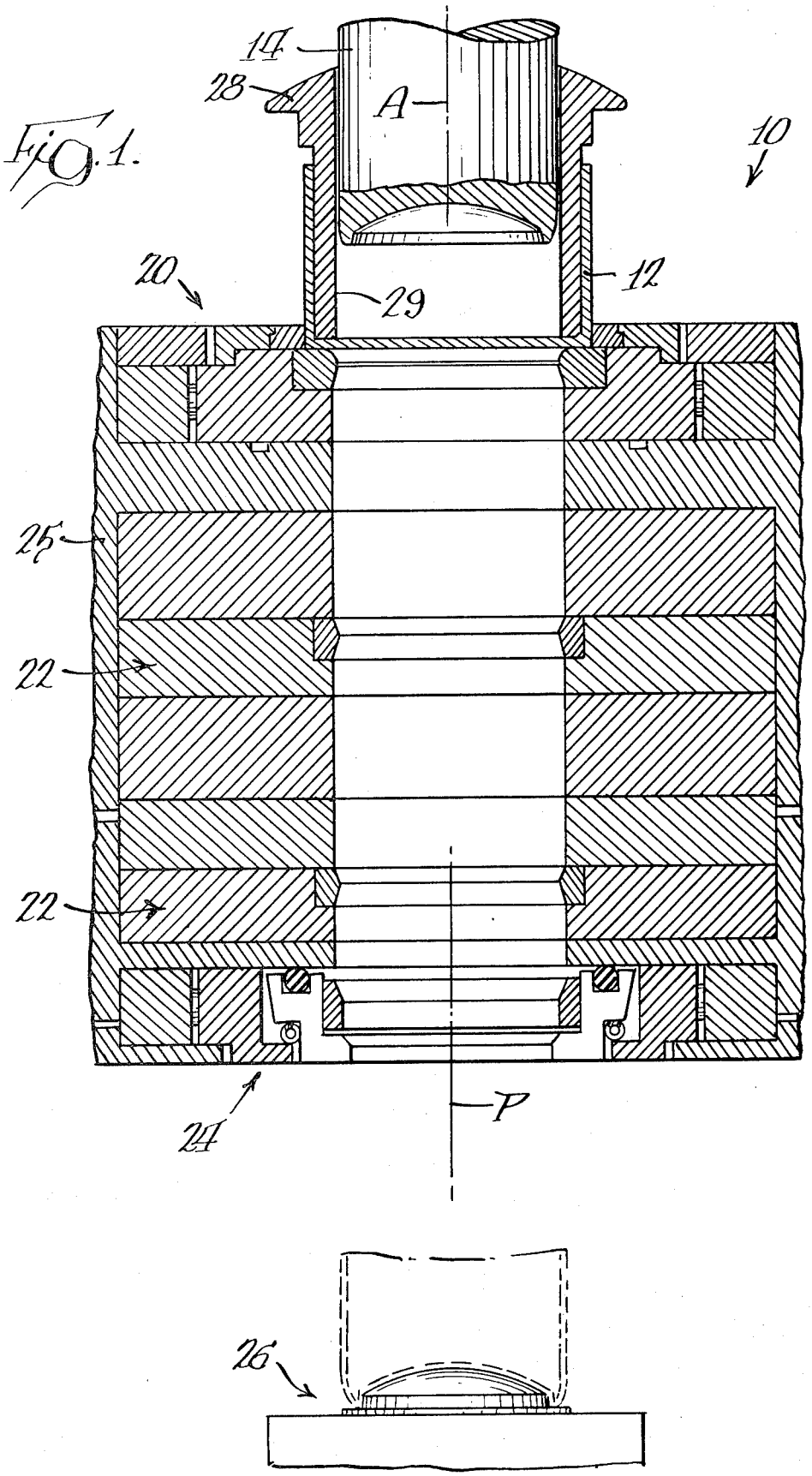
FIG. 1 schematically illustrates a fragmentary sectional view of a drawing and ironing machine into which the present invention can be incorporated.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings schematically illustrates selected portions of a bodymaker or press 10 used for converting a cup 12 into a finished drawn and ironed container. Bodymaker 10, which may be a Ragsdale type machine or press identified above, includes a punch 14 which is supported on a press ram (not shown) forming part of the press and is movable along a predetermined path P. The path P for punch 14 has a plurality of assemblies located at axially spaced positions which include a redraw die assembly 20, a pair of ironing die assemblies 22 and a stripper assembly 24, all supported by frame 25. A domer assembly 26 is spaced from stripper assembly 24 by a dimension which is greater than the height of the container, as will be described later. Bodymaker or press 10 also includes a cupper sleeve 28 which cooperates with redraw die assembly 20 and punch 14 for holding the cup 12 while the cup is redrawn through the cooperation between punch 14 and redraw assembly 20.

Before the stroke of punch 14 and cupper sleeve 28 is initiated, a cup 12 is generally aligned with redraw assembly 20 through a cup locating mechanism (not shown) and the sleeve is then moved into the open end of cup 12 and acts as a hold-down during the redrawing of the cup. Punch 14 is then moved axially through a bore 29 in sleeve 28 to force the cup through the opening in the redraw die assembly wherein the cup diameter is decreased and the cup height is increased. Continued movement of the punch 14 along path P will force the cup through the openings in the plurality of ironing assemblies to reduce the sidewall thickness of the cup. After the cup has been passed through the respective assemblies 20 and 22 and through stripper assembly 24, the lower end of punch 14, which is generally dome shaped in cross section, cooperates with domer assembly 26 to reform the bottom wall of the cup and produce a finished container. During the return stroke of punch 14, stripper assembly 24 engages the upper free edge of the finished container to strip the container from the punch.

According to a primary aspect of the present invention, redraw die assembly 20 is mounted on frame structure 25 in a manner that allows radial movement of the assembly with respect to the normal path of movement P of punch 14 to allow the assembly to be moved to a centered position with respect to the axis A of punch 14 should the punch be offset from the path P.

Figure 2:
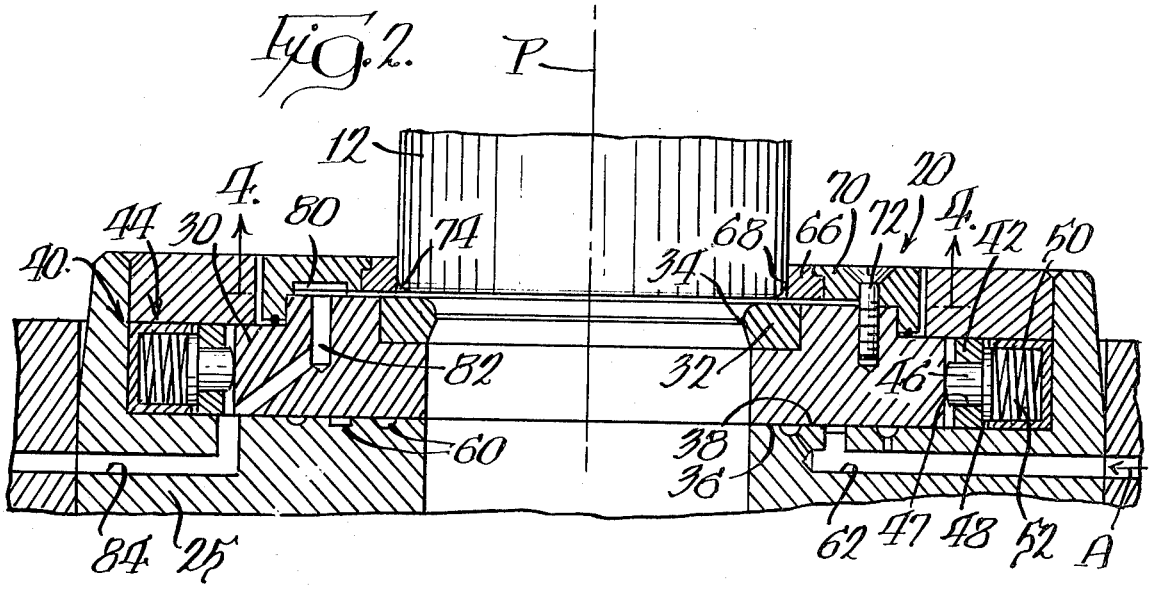
FIG. 2 is an enlarged fragmentary sectional view similar to FIG. 1 showing the details of the redraw die assembly.

As illustrated in FIG. 2, redraw die assembly 20 includes a support 30 which supports a redraw ring 32 that has a circular opening 34. Support 30 has a lower flat surface 36 which extends perpendicular to path P and is in extended engagement with a flat surface 38 that is defined on frame structure 25. The periphery of support 30 is perferably circular and centering means 40 cooperates with the periphery of support 30 to normally maintain support 30 and ring 32 centered with respect to path P. The centering means 40 consists of an annular ring 42 which is held in a fixed position on frame 25 and has a plurality of circumferentially spaced spring assemblies 44 associated therewith. Preferably, at least four such spring assemblies 44 are circumferentially equally spaced around the perimeter of support 30 and each spring assembly 44 includes a plunger 46 reciprocated in an opening 47 extending into the inner surface of ring 42. Plunger 46 has an enlarged flange 48 located in a cup 50 with a spring 52 also located in cup 50 which biases plunger 46 into engagement with the periphery of support 30. Normally all plungers 46 are biased to a position illustrated in FIG. 2 wherein the flange 48 of each plunger 46 is in engagement with a surface of ring 42 around opening 47. This arrangement defines an extremely accurate centered position of the opening 34 with respect to path P. However, should there by any misalignment between the axis A of punch and path P, one or more of the springs 52 will be compressed and support 30 moves radially of path P to allow the axis of opening 34 to be aligned with axis A of the punch. During such radial movement, only a selected number, less than all, of the springs 52 are compressed while the remaining springs located on the side opposite the direction of movement of support 30 will remain in their prestressed condition illustrated in FIG. 2. This arrangement insures that there is no resistance to having the die ring moved to a centered position with respect to path P after a cup has been forced through redraw ring 32 by punch 14. This arrangement also eliminates the possibility of having the redraw assembly off-center with respect to plane P because of varying forces applied by the respective springs.

According to another aspect of the invention, a fluid bearing is interposed between cooperating surfaces 36 and 38 to reduce the friction forces that must be overcome to allow radial movement of support 30 with respect to path P. For this purpose, support surface 36 has one or more annular recesses 60 defined therein and recesses 60 are in communication with a bore 62 which is defined in frame 25. A supply of pressurized fluid, such as air, is connected to the inlet end of bore 62 and is delivered to the respective annular recesses 60. Since the only exit from recesses 60 is along the surfaces 36 and 38, the fluid will act as a bearing surface to tend to separate these surfaces when external forces are applied to the redraw die assembly which will assist in allowing the opening 34 to move to a predetermined centered position with respect to punch 14.

According to a further aspect of the invention, the redraw die assembly also includes a centering mechanism for centering the cup 12 with respect to redraw ring 32 prior to having the punch enter the cup. This centering mechanism consists of a nesting ring 66 that has an opening 68 which is larger than opening 34. Nesting ring 66 is held in a fixed position with respect to redraw ring 32 through a support ring 70 which is held in a fixed position with respect to support 30 by screws 72 and thus forms a part of support 30. The diameter of opening 68 is substantially equal to the peripheral diameter of cup 12 as it is received by the redraw die assembly and is larger than the diameter of opening 34 so that a portion of the surface of ring 32 is exposed.

Thus, as the cupper sleeve enters cup 28 and moves towards redraw die assembly 20, the nesting ring 66 aids in centering the center of the cup with respect to the center of redraw ring 32 before punch 14 enters sleeve 28. This movement is in part assured by the fact that the lower peripheral end of cup 12 normally has a radiused portion 74 and the radiused portion will aid in guiding the periphery of cup 12 into opening 68 of centering ring 66. Of course, if there is axial misalignment between the center of openings 68 and 34 with respect to the center or axis of cup 12, biasing means 40 will allow the entire redraw die assembly to move radially with respect to path P. The diameter of bore 29 in sleeve 28 is slightly larger than the diameter of punch 14 so that redraw die assembly 20 and sleeve 28 with cup 12 clamped between them can move radially and the center of opening 34 will align with axis A of punch 14.

Another problem that has been encountered and was discussed above is the difficulty of supplying sufficient lubricant in an accurate and controlled manner into the critical areas between the cup and the redraw assembly for providing the necessary lubricant in such critical areas. The critical area in this instance is the upper exposed surface of the redraw die ring 32 and the lower peripheral surface of cup 12 as well as the periphery of opening 34 and the periphery of cup 12.

Figure 4:
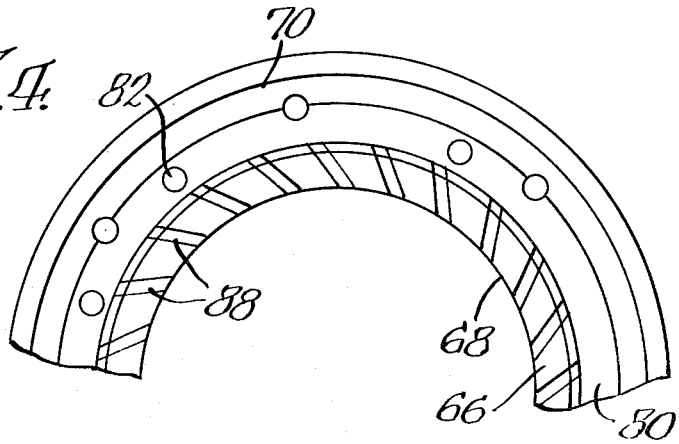
FIG. 4 is an enlarged plan view, as viewed along line 4—4 showing part of the redraw die assembly.

According to the further aspect of the invention, the nesting ring 66 also incorporates means for supplying lubricant between the exposed surface of redraw ring 32, which initially supports the cup and the adjacent surface of cup 12. As most clearly illustrated in FIG. 4, the lower surface of support ring 70 has an annular recess 80 defined therein and recess 80 is closed by a surface of support 30 to produce a channel. The channel is in communication with the periphery of support 30 through openings 82. A pressurized lubricant is supplied to openings through an opening 84 in frame 25. Annular recess or channel 80 is in communication with opening 68 through a plurality of non-radial recesses 88 in one surface of nesting ring 66 and recesses 88 are circumferentially spaced around the perimeter of opening 68. The recesses are closed by adjacent surfaces of support 30 and redraw ring 32 to produce flow paths. As illustrated in FIG. 4, all of the recesses or flow paths are generally linear and the axes of the flow paths are radially offset from the center of opening 68 in nesting ring 66. This arrangement insures that there is non-radial flow of the fluid from channel 80 through flow paths 88 into opening 68. Also, the radiused peripheral lower edge 74 of cup 12 (FIG. 2) will cooperate with the upper exposed surface of redraw ring 32 and the annular inner surface of opening 68 to produce a small channel for lubricant flow around the perimeter of the cup to all areas of the exposed surface of redraw ring 32.

Thus, the lubricant that is received into annular recess 80 flows through the respective recesses 88 into the channel created by the radius portion 74 and results in a circumferential flow of the lubricant within the channel during the redraw operation. Stated another way, the non-radial recesses slots 88 distribute the lubricant, which also acts as a coolant, in a vortex pattern across the redraw die surface during the redraw operation. The lubricant also cleans and cools the redraw die surface after the cup has been redrawn.

Figure 3:
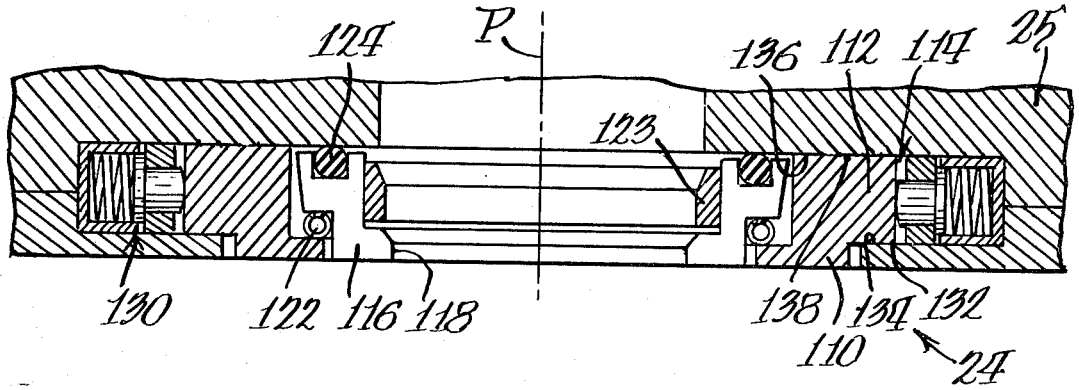
FIG. 3 is an enlarged fragmentary sectional view similar to FIG. 1 showing the details of the stripper assembly.

According to a further aspect of the present invention, stripper assembly 24 is also designed to accommodate radial movement of the assembly with respect to path P during a drawing and ironing operation. The stripper assembly 24 is illustrated in greater detail in FIG. 3 and includes a stripper support element 110 that has an enlarged portion 112 received into a recess 114 defined in support 25. A plurality of pivoted jaws 116 are located around the perimeter of path P and the lower edges of jaws 116 cooperate to define an opening 118 through which the finished container and punch 14 pass during the last part of the stroke of a drawing and ironing process. The respective jaws or segments 116 are held in a predetermined position through a resilient support member 122 and support ring 123 as well as an elastomeric member 124 as illustrated in FIG. 3. The jaws are biased to a position wherein the opening 118 is slightly smaller than the peripheral diameter of the finished container which passes therethrough. Thus, as the container and punch pass through opening 118, the lower edges of pivoted jaws 116 are moved outwardly slightly to accommodate the movement of the container therethrough. However, after the upper free edge of the container moves beyond the lower edge of the pivoted jaws 116, the jaws will move inwardly into the path of return movement of the upper free end of the container.

Stripper assembly 24 is again held in a centered position with respect to path P through biasing means 130 which can be identical to the biasing or centering means 40 described above. Thus, should for any reason, the axis of punch 14 with the finished container on it be offset somewhat from path P during the downward movement of the punch and container, the biasing means 130 will again accommodate radial movement of the entire stripper assembly with respect to path P to insure that there is no substantial interference between the container and the stripper jaws. Again, support 110 and frame 25 have flat radially extending cooperating surfaces that accommodate such radial movement. This arrangement insures that all of the jaws are located in the same position with respect to the periphery of the punch. This insures that the jaws which engage the free edge will engage across the entire width of the edge for more reliable stripping and less damage to the free edge.

As illustrated in FIG. 3, the lower surface of enlarged portion 112 has a flat annular surface 132 which is supported on an annular flat surface 134 that is defined on frame structure 25. Frame structure 25 also has an upper annular surface 136 which cooperates with flat upper surface 138 of support member 110.

It has been found that the use of the floating redraw ring and stripper in combination with the plurality of ironing assemblies substantially increases the productivity of a bodymaker of this type and produces containers that have a better finished appearance and have a uniform wall thickness throughout the entire diameter of each container as well as throughout the length thereof.

What is claimed is:

1. In a drawing and ironing machine including a frame having a redraw die assembly, at least one ironing assembly and a stripper assembly arranged in series and each having an opening to define a path with a punch movable along said path through said openings, the improvement of said redraw die assembly including a redraw ring having an opening, a support surrounding and supporting said ring, a nesting ring carried by said support and having an enlarged opening surrounding said opening in said redraw ring for aligning a cup with said redraw ring, lubricating means for supplying lubricant between said nesting ring and said support into an area between said cup and said redraw ring, and centering means surrounding said support and fixed to said frame for maintaining the center of said opening in said redraw ring aligned with said path and accommodating radial movement of said redraw ring to accommodate misalignment of the axis of said punch with respect to said path.

2. A drawing and ironing machine as defined in claim 1, in which said frame has a flat annular surface surrounding said path and said support has a flat surface in extended engagement with said flat annular surface, further including supply means for supplying a fluid medium between said surfaces.

3. A drawing and ironing machine as defined in claim 1, in which said nesting ring has a plurality of circumferentially spaced recesses on a surface thereof adjacent said redraw ring with said lubricant flowing through said recesses, said recesses defining non-radial paths for said lubricant with respect to the centers of said openings in said redraw ring and said nesting ring.

4. A drawing and ironing machine as defined in claim 1, in which said stripper assembly includes a support member and a plurality of stripping jaws pivoted on said support member and cooperating to define the opening for said punch, said support member and frame having cooperating flat surfaces accommodating relative radial movement with respect to said path, and centering means between said support member and said frame.

5. A drawing and ironing machine as defined in claim 4, in which said support and said support member have circular peripheral surfaces and each centering means includes an annular member with circumferentially spaced spring assemblies engaging the periphery of either said support or said support member.

6. A drawing and ironing machine as defined in claim 5, in which each centering means includes means for maintaining a predetermined stress on each of said spring assemblies.

7. A redraw die assembly for a drawing and ironing machine comprising a support, a redraw ring having a circular opening therein and an exposed surface surrounding said opening, a nesting ring on said support surrounding said exposed surface and having an opening for receiving a cup and centering said cup with respect to said opening in said redraw ring, and means for supplying lubricant between said support and said nesting ring to said exposed surface while a cup is in the opening of said nesting ring.

8. A redraw die assembly as defined in clain 7, in which said support has a channel surrounding said nesting ring with circumferentially spaced flow paths leading from said channel to said opening in said nesting ring and in which said flow paths are non-radial with respect to the center of said opening in said nesting ring.

9. A redraw die assembly as defined in clain 8, in which said nesting ring has circumferentially spaced recesses on a surface adjacent said redraw ring and said support has a surface engaging said surface with said recesses to define said flow paths.

10. A redraw die assembly as defined in claim 7, in which said drawing and ironing assembly includes a frame having an opening aligned with said opening in said redraw ring and a flat annular surface surrounding said opening and in which said support has a flat surface engaging said annular surface, said flat annular surface having annular recesses with means for supplying pressurized air to said recesses to produce a fluid bearing between said surfaces.

* * * * *